US007290652B2

(12) United States Patent
Rath

(10) Patent No.: US 7,290,652 B2
(45) Date of Patent: Nov. 6, 2007

(54) CONTAINER, ESPECIALLY FOR CIGARETTES

(76) Inventor: Josef Rath, 8211 Grosspesendorf 41, Ilztal, A-8211 (AT)

( * ) Notice: Subject to any disclaimer, the term of this patent is extended or adjusted under 35 U.S.C. 154(b) by 163 days.

(21) Appl. No.: 10/504,266

(22) PCT Filed: Feb. 17, 2003

(86) PCT No.: PCT/AT03/00049

§ 371 (c)(1),
(2), (4) Date: Feb. 16, 2005

(87) PCT Pub. No.: WO03/070601

PCT Pub. Date: Aug. 28, 2003

(65) Prior Publication Data

US 2005/0130822 A1 Jun. 16, 2005

(30) Foreign Application Priority Data

Feb. 20, 2002 (AT) ..... A 260/2002

(51) Int. Cl.
*A24F 15/00* (2006.01)

(52) U.S. Cl. ..... 206/271; 206/265; 206/273; 206/242; 229/87.13

(58) Field of Classification Search ..... 206/271, 206/565, 269, 242, 259, 261, 250, 251, 254, 206/255, 262, 264, 265, 273; 229/87.12, 229/87.13, 87.14
See application file for complete search history.

(56) References Cited

U.S. PATENT DOCUMENTS

| | | | | | |
|---|---|---|---|---|---|
| 3,387,736 | A * | 6/1968 | Williamson | ..... | 220/270 |
| 3,948,389 | A * | 4/1976 | Molins et al. | ..... | 206/245 |
| 4,947,994 | A * | 8/1990 | Newsome | ..... | 229/203 |
| 5,129,513 | A * | 7/1992 | David et al. | ..... | 206/265 |
| 5,160,024 | A * | 11/1992 | Evers | ..... | 206/268 |
| 5,192,262 | A * | 3/1993 | Amendola et al. | ..... | 493/365 |
| 5,236,084 | A * | 8/1993 | Evers | ..... | 206/273 |
| 5,533,613 | A * | 7/1996 | Minarelli et al. | ..... | 206/268 |
| 5,558,217 | A * | 9/1996 | Focke et al. | ..... | 206/268 |
| 6,244,435 | B1 * | 6/2001 | Cho | ..... | 206/264 |

* cited by examiner

*Primary Examiner*—Mickey Yu
*Assistant Examiner*—Steven A. Reynolds
(74) *Attorney, Agent, or Firm*—David A. Guerra

(57) ABSTRACT

The invention relates to a container, especially for cigarettes, having a base and a lid. The base includes a bottom area and a first wall, and the lid includes a cover area and a second wall. The base and the lid are hinged to each other on a first side of the first wall and a first side of the second wall. When the container is in a closed state, a gap is formed between the other sides of the first wall and the other sides of the second wall. A protective cover is disposed around the base and the lid when the container is in the closed state. The protective cover, in the area of the gap, is provided with a perforated section and is at least partially linked with the base and/or the lid, especially glued to it or linked with it in a similar manner.

14 Claims, 11 Drawing Sheets

CONTAINER, ESPECIALLY FOR CIGARETTES

The invention relates to a packing, especially for cigarettes, with a basic body comprising a floor surface and a first wall and a cap comprising a cover surface and a second wall, with the basic body and the cap being joined with each other at a first side of the first wall and a first side of the second wall in a tiltable manner, with a gap being formed in the closed state of the packing between the further sides of the first wall and the further sides of the second wall, with a protective wrapping being arranged around the basic body and the cap at least in the closed state of the packing, with the protective wrapping having a perforation in the region of the gap and being joined with the basic body and/or the cap at least in sections, especially glued or the like.

Known such packings comprise a basic body made of cardboard or the like with a cellophane film as a protective wrapping. The protective wrapping is torn open during the first opening of the packing by means of a tape and thereafter the protective wrapping, which is arranged adjacent to the cap, and the tape are removed from the packing.

The disadvantageous aspect in these packings is that the part of the protective wrapping which is arranged adjacent to the cap and the tape are obtained as waste during the first opening of the packing and need to be disposed of.

U.S. Pat. No. 5,192,262 discloses such a packing for a cigarette box where the protective wrapping comprises perforations forming a tear tape. The disadvantageous aspect in the device according to U.S. Pat. No. 5,192,262 is that during the first-time opening of the packing the tear tape is removed from the outer covering and is obtained as waste.

It is the object of the present invention to provide a packing, especially for cigarettes, of the kind mentioned above in which the basic body is protected by a protective wrapping and in which no waste is obtained during the first opening.

This is achieved in accordance with the invention in such a way that the cap comprises in the region of the further sides of the second wall a tab which can be inserted into a diametrically opposed slot which is arranged in the basic body or formed by the first wall and a stiffening element, with the tab being inserted in the slot in the closed state.

This leads to the advantage that the protective wrapping can be opened along the perforation without having to remove parts such as a tape or the like from the protective wrapping. By joining the protective wrapping with the basic body and/or the cap it is ensured that the protective wrapping, during the tilting of the cap, will follow the same both during opening as well as closing. The tab offers in addition to the perforation a protection against any inadvertent opening of the packing, so that any loads occurring during the handling of the packing which might cause an inadvertent opening of the packing can be absorbed by the tab. By forming the slot by the first wall and a stiffening element, the slot can be produced without weakening the basic body.

In a further development of the invention it can be provided that the protective wrapping is glued at least over the entire length of the perforation with the basic body and the cap by means of an adhesive and that the adhesive seals openings of the perforation in the closed state of the packing. By joining the protective wrapping with the basic body and the cap at least over the entire region of the perforation, it is possible to ensure that the protective wrapping will not detach from the cap and/or the basic body in this region. The sealing of the perforation by the adhesive ensures in a simple manner that no humidity can penetrate through the openings of the perforation.

In this connection it can be provided according to another embodiment of the invention that the adhesive is wax-like. A favorable sealing of the perforation can be achieved with a wax-like adhesive in a simple manner and at low production costs for the packing in accordance with the invention, with the protective wrapping still being easy to open along the perforation.

According to a further embodiment of the invention it can be provided that the protective wrapping is made integrally from a film, especially a cellophane film or the like. This embodiment represents a simple and inexpensive production of the protective wrapping.

According to another embodiment of the invention it can be provided that in the known manner an insert is provided which is arranged so as to rest on the basic body and cap at least in the closed state of the packing and that said insert is connected to the cap at least in sections, especially glued or the like. In this way it is possible that the insert, which represents an additional protection for the items packed into the packing in accordance with the invention, can also be opened without obtaining waste therefrom during the first opening of the packing in accordance with the invention.

It can be provided for in a further embodiment of the invention that the insert comprises a closure region which can be severed from the insert along a further perforation or the like and that the closure region is joined with the cap, at least in sections. This ensures that the closure region remains joined with the packing even after the severing of the remaining insert from the packing.

It can be provided for in a further embodiment of the invention that the tab can be flipped into the cap. The cap can thus be reinforced for multiple opening and closing.

According to a further embodiment of the invention it can be provided that the tab comprises at least one nose which can be latched into a recess of the cap. The nose can thus fix the tab in the cap.

According to another embodiment of the invention it can be provided that the tab is arranged in an offset fashion relative to the second wall substantially by the wall thickness of the first wall in the region of the gap, especially by means of a double fold or the like. This ensures that no projections or the like are formed in the outside shape of the closed packing in accordance with the invention.

The invention further relates to a method for opening a closed packing, as described above.

It is the object of the present invention to provide a method in which waste is avoided. This is achieved in accordance with the invention in such a way that in a first step a protective wrapping is severed along a perforation, whereupon a cap is flipped open and a tab is pulled out of a slot in the basic body in the region of the further sides of the second wall and optionally a closure region of an insert which is joined with the cap is severed along a further perforation, whereupon the tab is flipped into the cap, with the closure region being arrangeable at least partly between the cap and the tab. This leads to the advantage that a multi-layer packing can be opened in a simple manner without removing parts or the like.

In a further development of the invention it can be provided that the tab is latched by means of noses in diametrically opposed recesses in the cap. By latching the tab in the cap by means of the noses, it is possible to fix them in a simple manner. A part of the closure region between the tab and the cap can optionally be enclosed.

The invention is now explained in closer detail by reference to the enclosed drawings showing embodiments of the invention, wherein.

Figure 1:
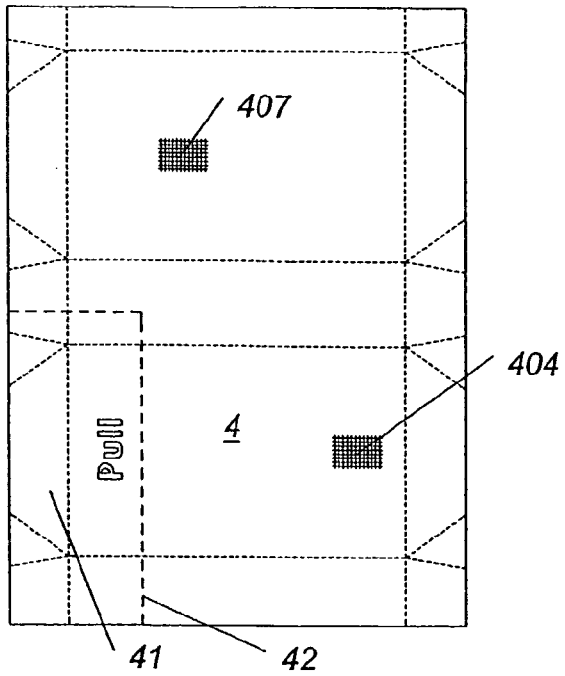
Fig. 1 (Prior Art)
FIG. 1 shows a folding layout of a conventional insert.

FIG. 1 shows the insert 4 of a conventional cigarette box. The insert 4 comprises a closure region 41 which is delimited from the further insert 4 by means of a further perforation 42. The insert 4 comprises two gluing points 404 and 407. The insert 4 is folded along the dotted lines.

Figure 2:
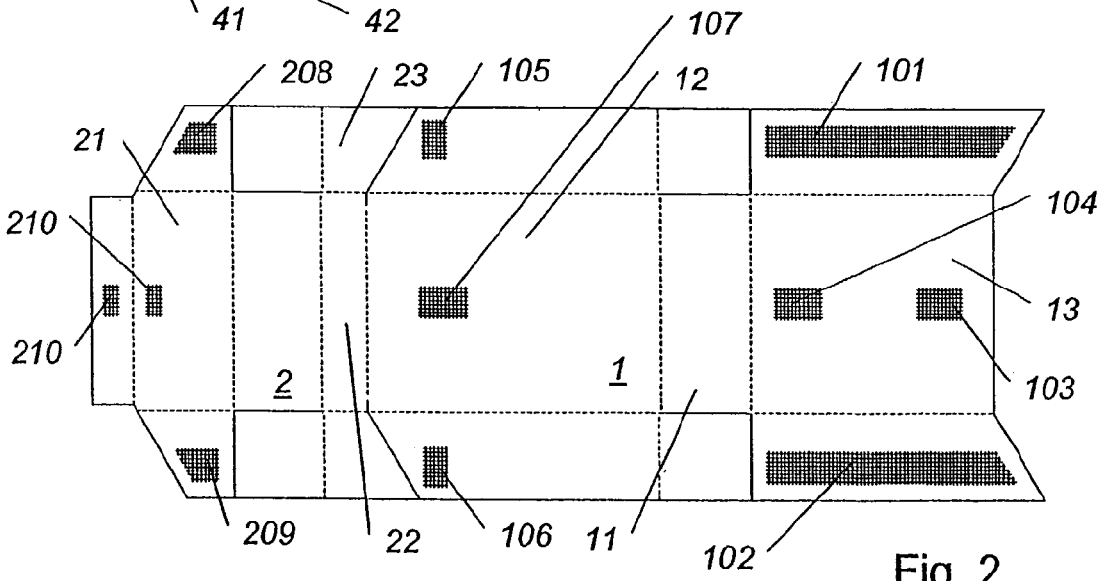
Fig. 2 (Prior Art)
FIG. 2 shows a folding layout of a conventional basic body and a cap.

FIG. 2 shows the folding layout of a basic body 1 and a cap 2 of a conventional cigarette box. The basic body 1 comprises a floor surface 11 and a first wall 12, 13. The cap comprises the cover surface 21 and a second wall 22, 23, with the basic body 1 and the cap 2 being joined with each other in a tiltable manner on a first side 12 of the first wall 12, 13 and a first side 22 of the second wall 22, 23. The basic body comprises gluing points 101 through 107. The cap comprises gluing points 208 to 210, with the two gluing points 210 being glued with each other in the completed cigarette box. The gluing points 104 and 107 are glued together with the gluing points 404 and 407 of the insert 4.

Figure 3:
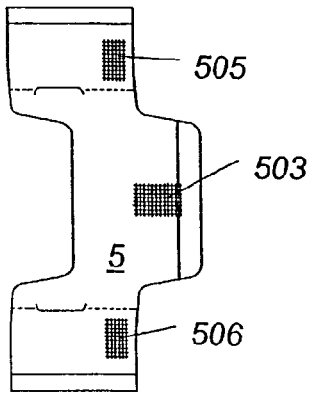
Fig. 3 (Prior Art)
FIG. 3 shows a folding layout of a conventional stiffening element.

FIG. 3 shows the folding layout of a stiffening element 5 of a conventional cigarette box. It comprises gluing points 503, 505 and 506 which are glued together with the respective gluing points 103, 105 and 106 of the basic body. A conventional cigarette box is enclosed in the closed state by a protective wrapping 3 which protects from humidity the basic body 1 and the cap 2 which can be made of cardboard. The closed state of the packing characterizes the state of the packing before the first time opening. If the packing is closed after the first-time opening again, the packing is in the closed state.

In the first-time opening of a conventional cigarette box, the protective wrapping 3 is divided in the region of the cap 2 by means of a tape and the partial element which is arranged adjacent to the cap 2 as well as the tape are removed. Thereafter the cap 2 is opened and the closure region 41 of the insert 4 is pulled out of the packing, with the same being severed along the further perforation 42. After the opening the packing, both the partial section of the protective wrapping 3, the tape as well as the closure region 41 of the insert 4 must be disposed as waste.

Figure 4:
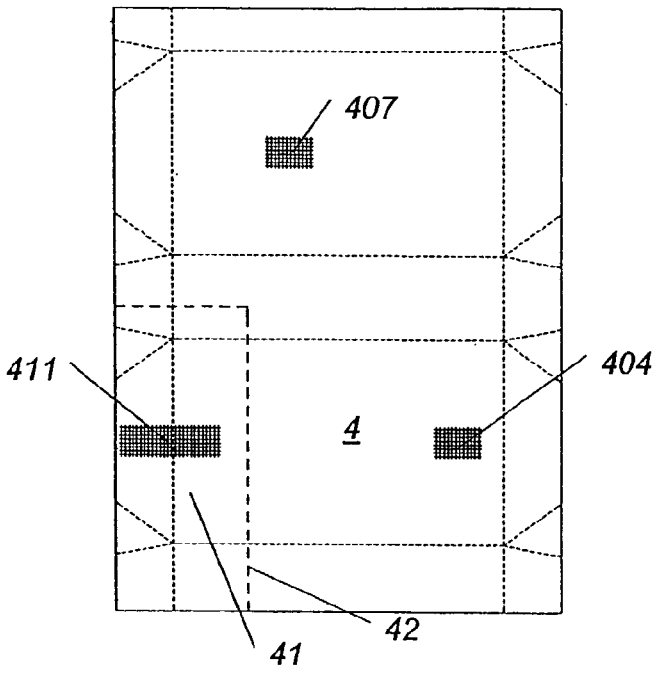
FIG. 4 shows a folding layout of an insert of a first embodiment in accordance with the invention.
Figure 5:
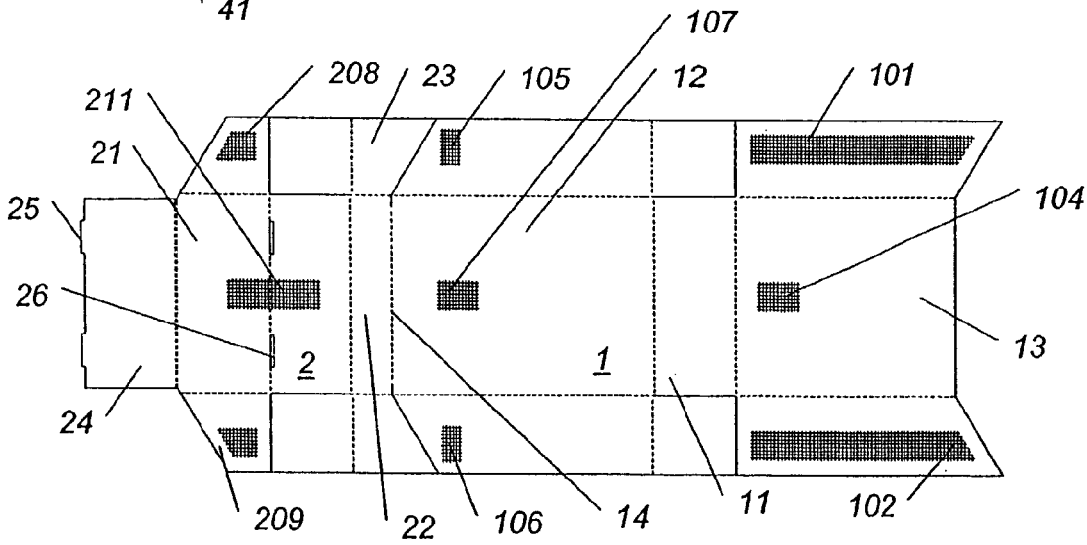
FIG. 5 shows a folding layout of the basic body and the cap of the first embodiment in accordance with the invention.
Figure 6:
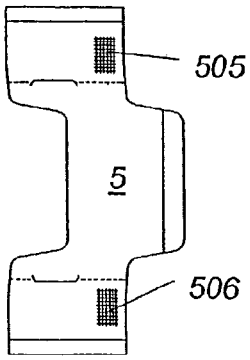
FIG. 6 shows a folding layout of the stiffening element of the first embodiment in accordance with the invention.

FIGS. 4 to 6 show folding layouts of the first embodiment of a packing in accordance with the invention, with FIG. 4 showing the folding layout of insert 4, FIG. 5 showing the folding layout of basic body 1 and cap 2 and FIG. 6 showing the folding layout of the stiffening element 5. The folding layouts are especially suitable for a packing for cigarettes.

The basic body 1 comprises a floor surface 11 and a first wall 12, 13 comprising a first side 12 and further sides 13. Cap 2 comprises a cover surface 22 and a second wall 22, 23 which comprises a first wall 22 and further walls 23. The basic body 1 and the cap 2 are connected in a tilting manner with each other on the first side 12 of the first wall 12, 13 and one the first side 22 of the second wall 22, 23. In the illustrated embodiment, the tilting joint is formed by a fold 14, so that the basic body 1 and the cap 2 are joined with each other in an integral manner. In other embodiments of the invention it is possible that the basic body 1 and the cap 2 are also produced in a separated manner and can be joined with each other by means of a tilting joint. In the folded state of the basic body 1 and the cap 2, a gap is formed in the closed state of the packing between the further sides 13 of the first wall 12, 13 and the further sides 23 of the second wall 22, 23.

The basic body 1 comprises the gluing points 101, 102, 104, 105, 106 and 107, the cap the gluing points 208, 209 and 211, the insert the gluing points 404, 407 and 411 and the stiffening element the gluing points 505 and 506. The gluing points 101, 102 are required in the folding of the basic body 1 and the gluing points 208 and 209 in the folding of the cap 2. The other gluing points are glued with each other in such a way that the same end figures come together, e.g. 211 with 411. It is sufficient when an adhesive or the like is applied to one of the mutually combined gluing points.

Figure 7:
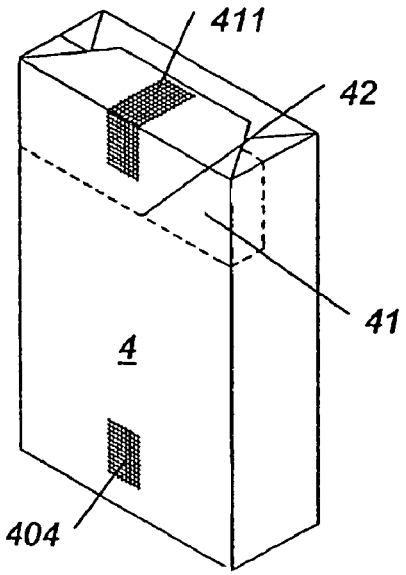
FIGS. 7 and 8 show the insert of the first embodiment in an oblique view each.
Figure 8:
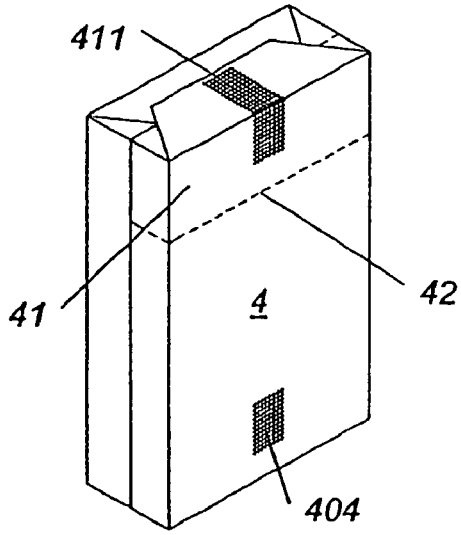

FIGS. 7 and 8 show the insert 4 according to the first embodiment of the invention. It can be folded from the folding layout according to FIG. 3 and comprises the closure region 41 which can be severed from the remaining insert 4 by means of the further perforation 42.

Figure 9:
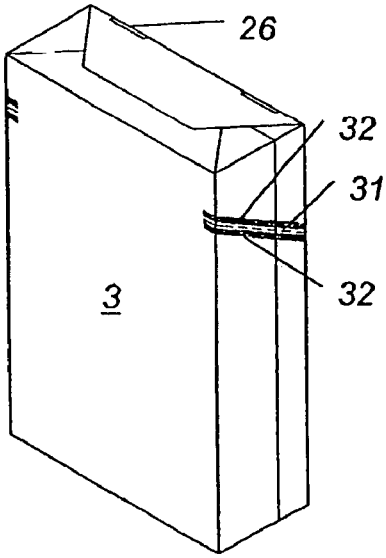
FIGS. 9 and 10 show the protective wrapping of the first embodiment in an oblique view each.
Figure 10:
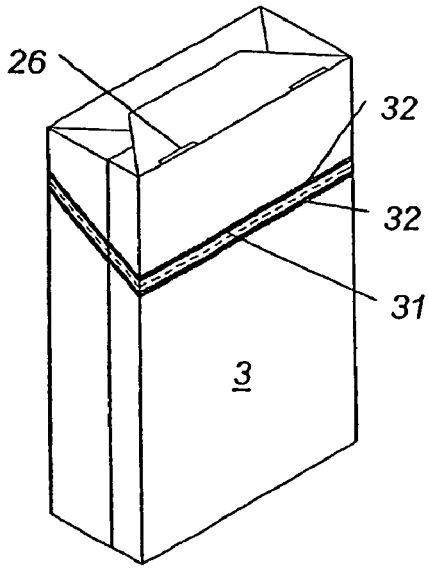

The closed packing is shown in the FIGS. 9 and 10. It is enclosed by the protective wrapping 3 which comprises a perforation 31 and is joined to the basic body 1 and the cap 2. The perforation 31 is arranged in the region of the gap which is formed by the further sides 13 of the first wall 12, 13 and the further sides 23 of the second wall 22, 23. The connection is formed in FIGS. 9 and 10 by an adhesive 32 which is arranged between the basic body 1 and the protective wrapping 3 and the cap 2 and the protective wrapping 3. In the shown embodiment, the adhesive 32 is applied over the entire length of the perforation 31, so that the protective wrapping 3 is glued over the entire length of the perforation 31 with the basic body 1 and the cap 2. It appears to be further preferable when the adhesive 32 seals openings of the perforation 31 in the closed state of the packing, so that no humidity can reach into the packing through the perforation 31. In this connection it has been proven to be advantageous when the adhesive 32 is wax-like. It is provided for in other embodiments that the protective wrapping 3 is joined either only with the basic body 1 or with the cap 2. It can also be provided that the protective wrapping 3 is joined only in sections with the basic body 1 and/or the cap 2. The protective wrapping 3 can be formed in a simple manner in an integral manner from a film, with a cellophane film being especially suitable. By using a cellophane film it is possible to provide the protective wrapping 3 with a transparent configuration, as a result of which any imprint or the like on the basic body 1 and/or the cap 2 can be seen in the closed state of the packing through the protective wrapping 3. In other embodiments it can also be provided that the protective wrapping is joined at further regions with the basic body 1 and/or the cap 2.

In the closed state of the packing, the insert (which is shown in FIGS. 7 and 8) is arranged so as to rest close to the basic body 1 and cap 2, with the perforation 42 being arranged in the region of the gap between the further sides 13 of the first wall 12, 13 and the further sides 23 of the second wall 22, 23. The insert 4 is joined with the gluing points 404 and 407 to the gluing point 104 and 107 of the basic body and with a gluing point 411 to the gluing point 211 of the cap. The connection can also occur with other known means. In other embodiments of the invention these gluing points 104, 404, 107, 407, 211, 411 can also be arranged differently. In the case of the presence of an insert 4, the connection of the closure region 41 with the cap 2 is especially advantageous.

Figure 11:
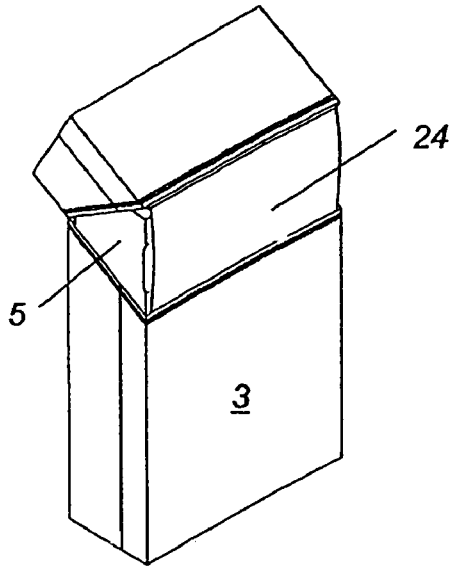
FIGS. 11 through 14 show four views during the first-time opening of the first embodiment in accordance with the invention in an oblique view.
Figure 12:
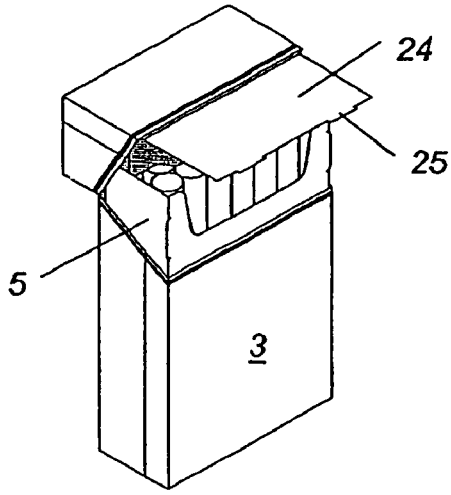
Figure 13:
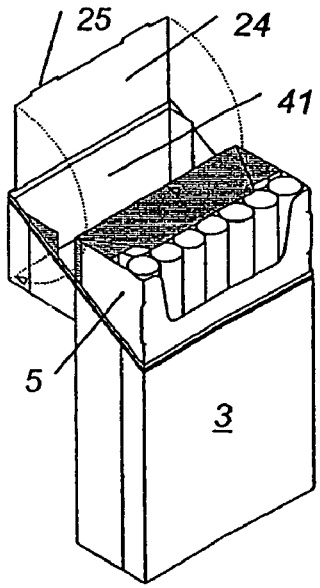
Figure 14:
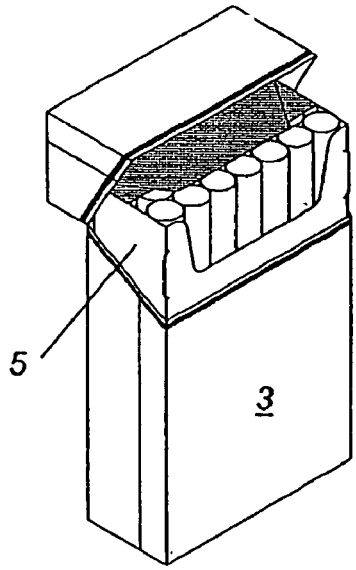

FIGS. 11 to 14 show the first opening of the closed packing in accordance with the invention according to FIGS. 4 to 10. FIG. 11 shows that the cap 2 comprises a tab 24 in the region of the further sides 23 of the second wall 22, 23, which tab can be inserted into a diametrically opposed slit 15 of the basic body 1. FIG. 13 shows that the tab 24 can be flipped into the cap 2. The tab 24 can be provided with noses 25 which can each be latched into a recess 26 of the cap 2. The recesses 26 of the cap 2 are shown in FIGS. 5, 9 and 10. Embodiments with a different number and configuration of the noses 25 and recesses 26 are provided.

The slot 15 can be introduced into the further sides 13 of the first wall 12, 13 or be formed by the first wall 12, 13 and the stiffening element 5. The configuration between the first wall 12, 13 and the stiffening element 5 can be produced in a simple manner, with the packing not being weakened by the slot 15.

FIGS. 15 to 20 show the process of the first-time opening and renewed closure of the first embodiment of the packing in accordance with the invention in a sectional view. Glued regions are shown by a dotted line.

Figure 15:
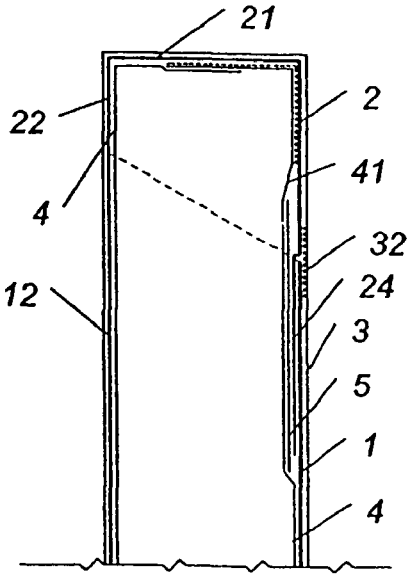
FIGS. 15 to 20 show six views during the first-time opening and renewed closure of the first embodiment in accordance with the invention, in a sectional view each.
Figure 16:
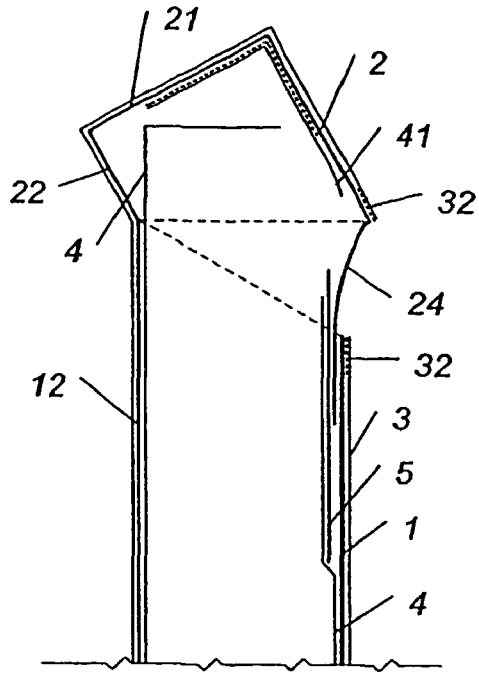
Figure 17:
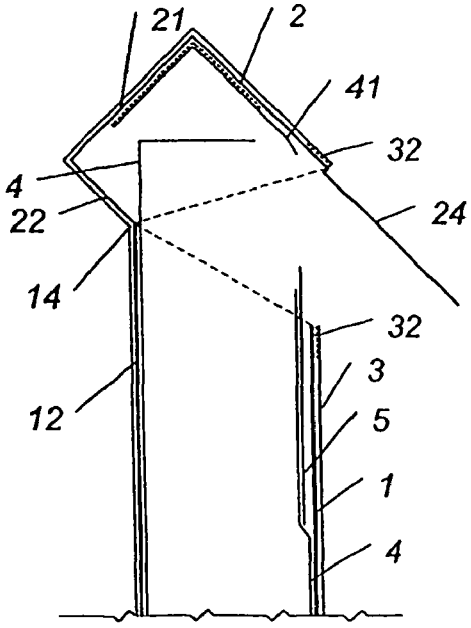
Figure 18:
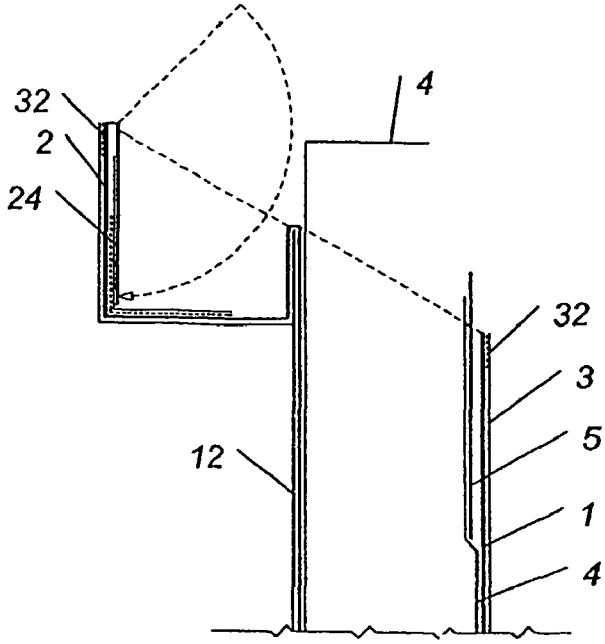
Figure 19:
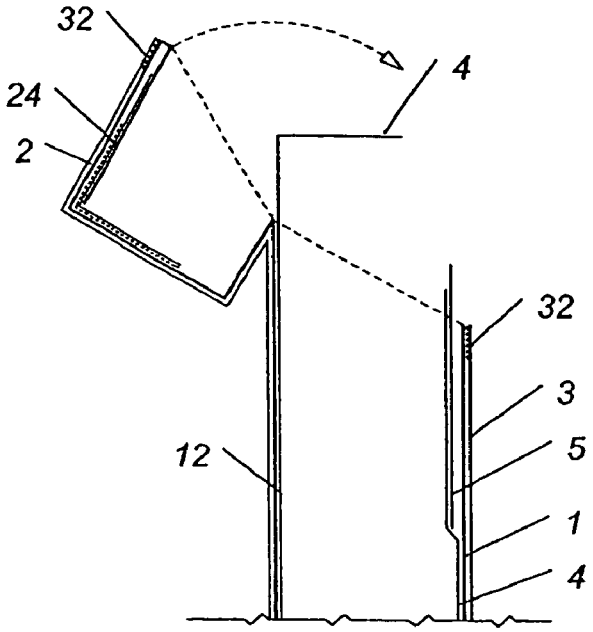
Figure 20:
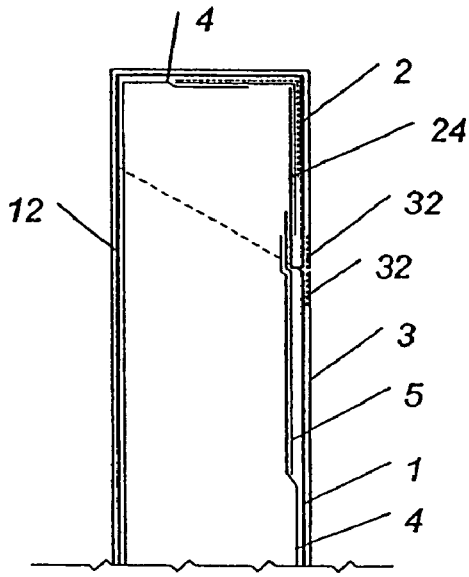

FIG. 15 shows the first embodiment of the packing in accordance with the invention in the closed state, with the delimitation of the basic body 1 and the cap 2 being indicated by means of the broken line. In the region of the gap between the basic body 1 and the cap 2, the tab 24 is attached to the cap 2, with the tab 24 being arranged in an offset manner relative to the second wall 22, 23 substantially by the wall thickness of the first wall 12, 13 in the region of the gap. It can thus be ensured that the transition between the basic body 1 and the cap 2 is configured in a plane manner and without any projections. A double fold seems to be suitable for the offset configuration, as is shown in FIG. 15. It is also possible to use other known means. The slot 15 is formed by the basic body 1 and the stiffening element 5, so that the tab 24 is arranged in the closed state at least in sections between the basic body 1 and the stiffening element 5. The insert 4 is arranged in the interior of the basic body 1 and the cap 2. The protective wrapping 3 is arranged around the basic body 1 and the cap 2.

When opening the closed packing in accordance with the invention, the protective wrapping 3 is severed along the perforation 31 in a first step. This can be performed with a preferably blunt instrument, especially a fingernail or the like. The perforation 31 can also be severed by applying a tilting moment on cap 2. Thereafter the cap 2 is flipped open, with the tab 24 being pulled from the slot 15. If an insert is provided, the closure region 41 is severed along the further perforation 42 from the remaining insert. When the cap 2 is flipped open, the tab 24 is swiveled into the cap 2, with the closure region 41 optionally being arrangeable at least partly between cap 2 and tab 24. Thereafter the packing can be brought to the closed state by tilting back the cap 2. In contrast to the sealed state (FIG. 15), the perforation 31 of the protective wrapping 3 is severed in the closed state (FIG. 20) of the packing in accordance with the invention and optionally the closure region 41 is separated from the remaining insert 4 along the further perforation 42. Preferably, the tab 24 is swiveled into the cap 2. It is latched by means of noses 25 in diametrically opposed recesses 26.

As a result of tab 24, which offers frictional resistance against the opening of the packing in accordance with the invention, it is possible to ensure that for the opening of the packing in accordance with the invention a predeterminable force is required, so that the likelihood of inadvertent opening can be excluded to a substantial extent during storage or transport. In other embodiments of the packing in accordance with the invention it can also be provided that the tab 24 is guided through the slot 15 again in the closed state.

Figure 21:
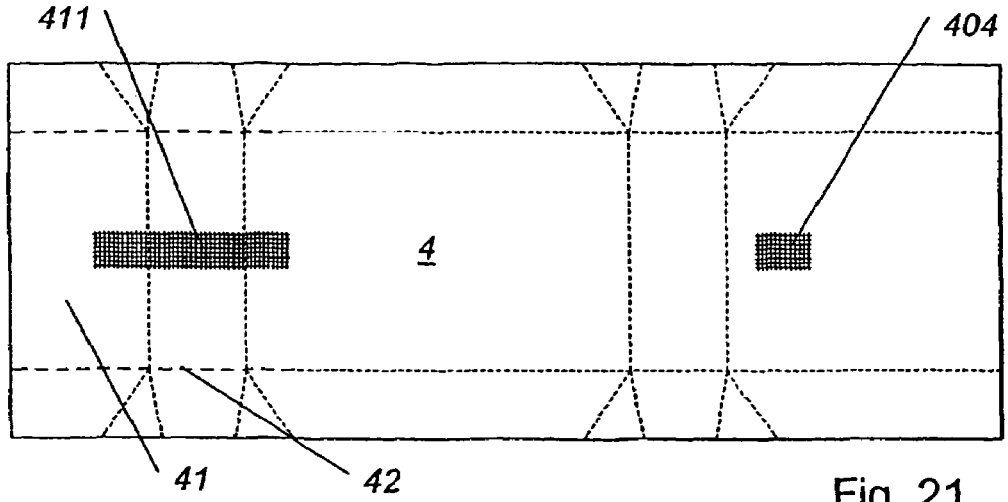
FIG. 21 shows a folding layout of the insert of a further embodiment in accordance with the invention.
Figure 24:
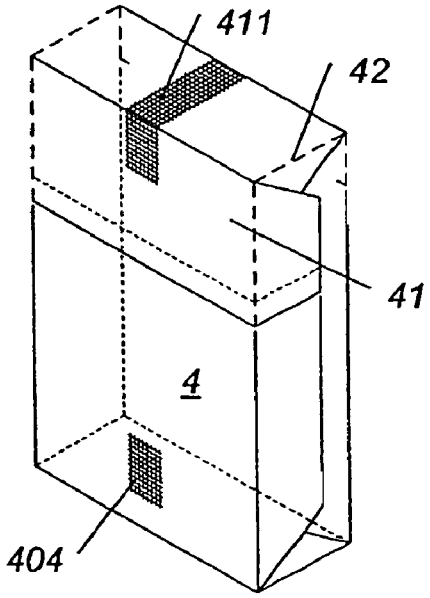
FIGS. 24 and 25 show the insert of the further embodiment in an oblique view each.
Figure 25:
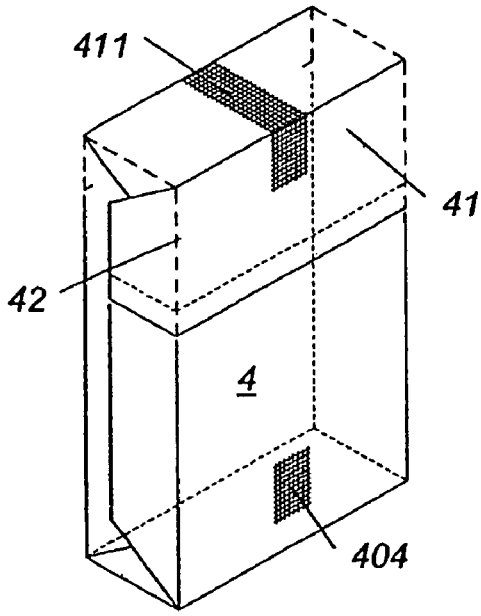
Figure 26:
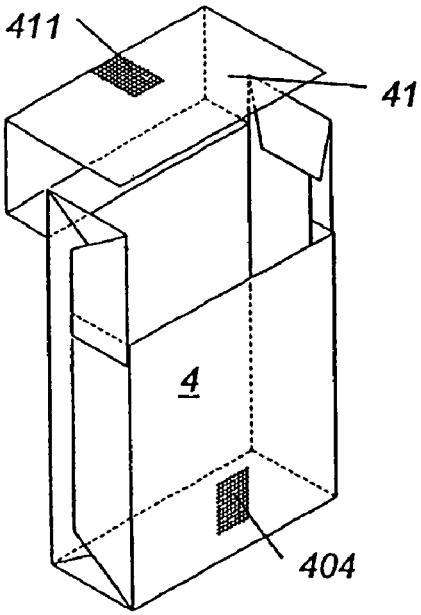
FIG. 26 shows the insert according to FIGS. 24 and 25 in the opened state.

FIGS. 21 to 38 show a further embodiment of the packing in accordance with the invention. It is distinguished from the first embodiment shown in the FIGS. 4 to 20 essentially by a different configuration of the insert 4 whose folding layout is shown in FIG. 21. FIGS. 24 to 26 show the folded insert 4. The advantageous aspect in this embodiment is that the insert 4 remains integral even after the opening of the packing and the closure region 41 is not severed completely from the remaining insert 4, as is shown from FIG. 26.

Figure 22:
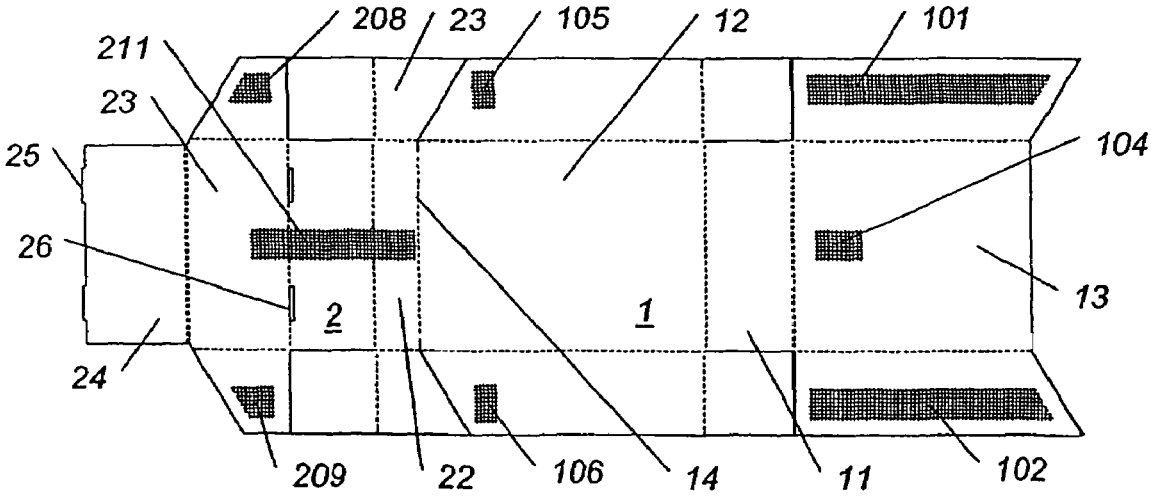
FIG. 22 shows a folding layout of the basic body and the cap of the further embodiment in accordance with the invention.
Figure 23:
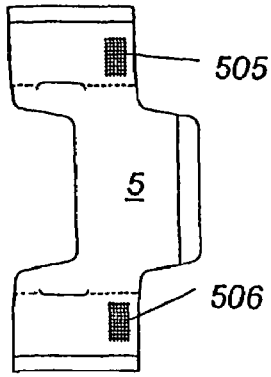
FIG. 23 shows a folding layout of the stiffening element of the further embodiment in accordance with the invention.
Figure 27:
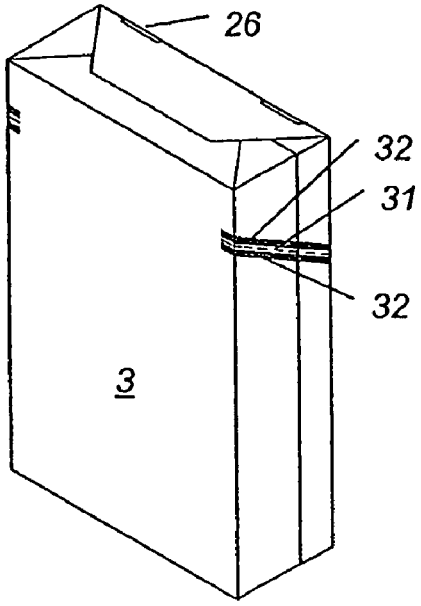
FIGS. 27 and 28 show the protective wrapping of the first embodiment in an oblique view each.
Figure 28:
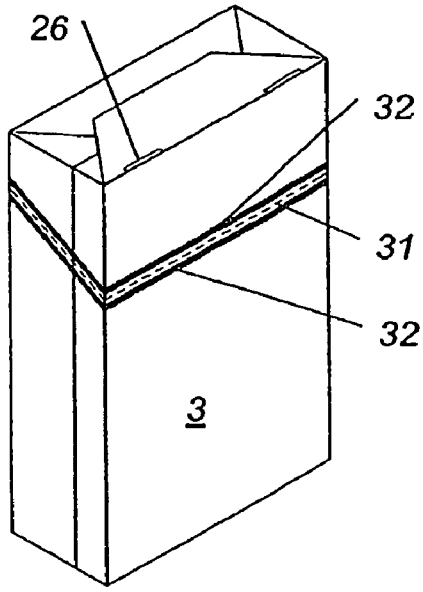
Figure 29:
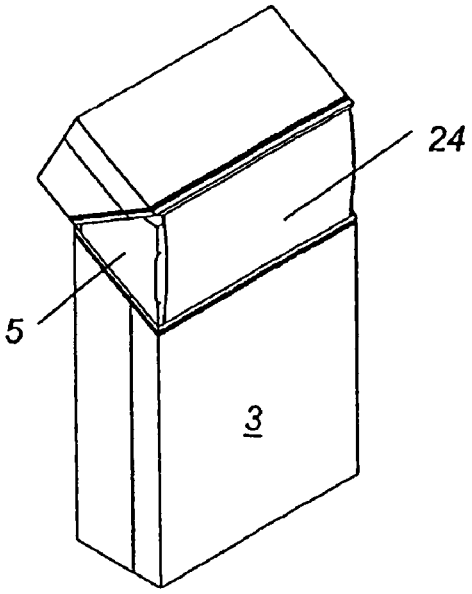
FIGS. 29 to 32 show four views of the first-time opening of the further embodiment in accordance with the invention, each in an oblique view.
Figure 30:
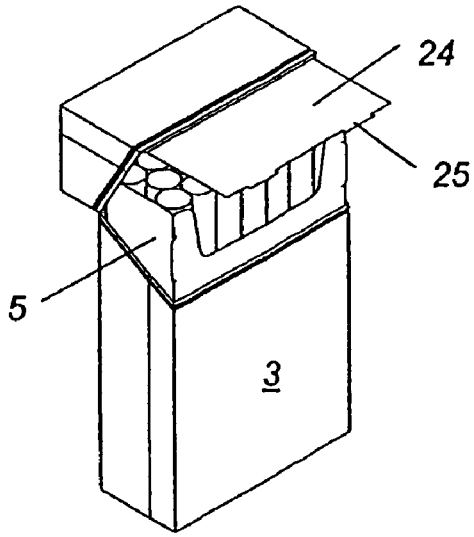
Figure 31:
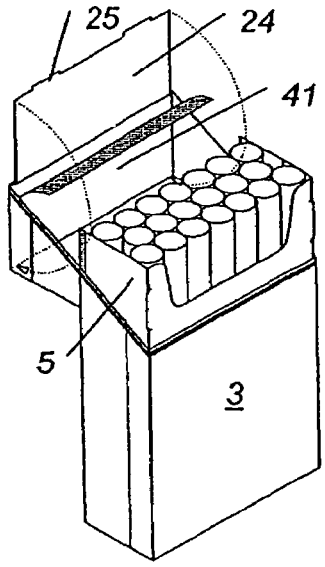
Figure 32:
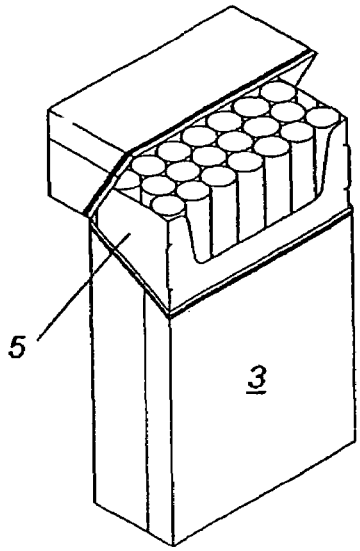
Figure 33:
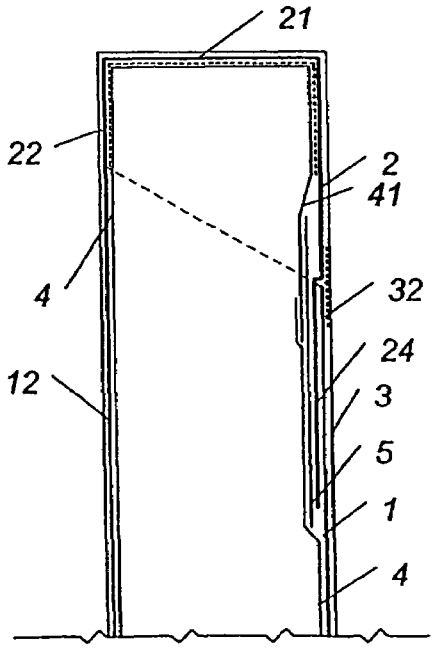
FIGS. 33 to 38 show six views of the first-time opening and renewed closure of the further embodiment in accordance with the invention, each in a sectional view.
Figure 34:
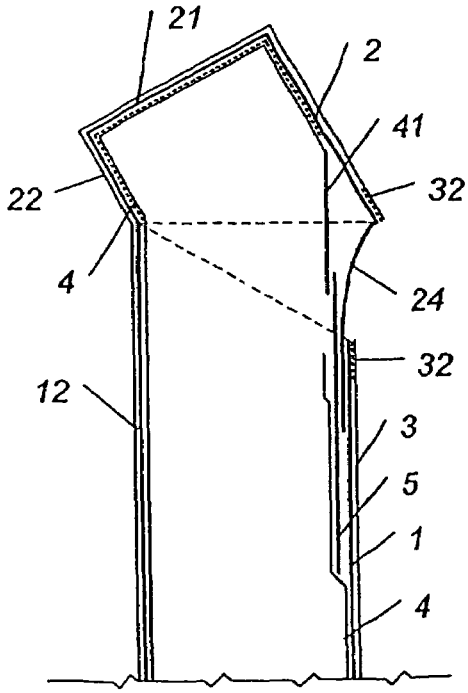
Figure 35:
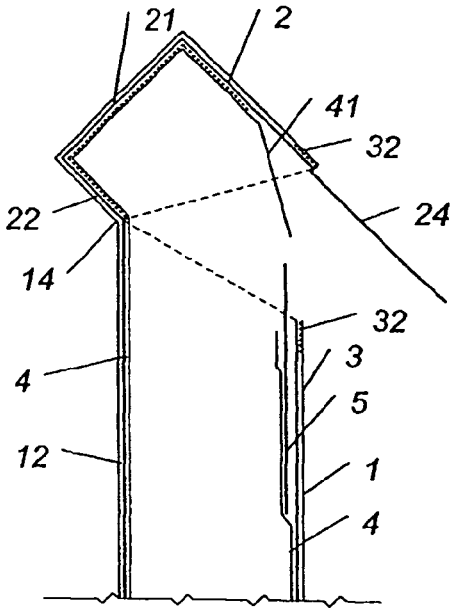
Figure 36:
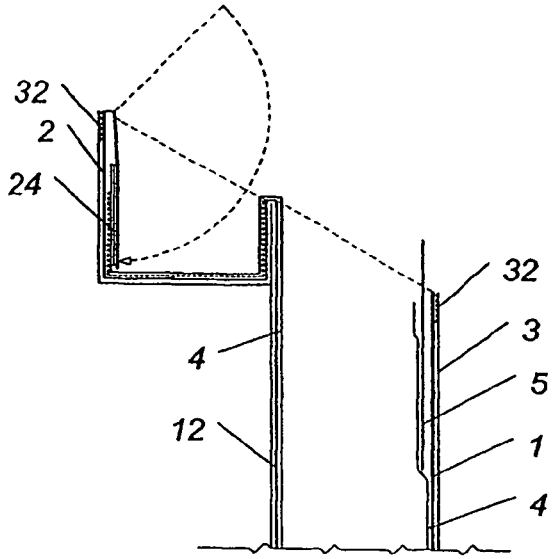
Figure 37:
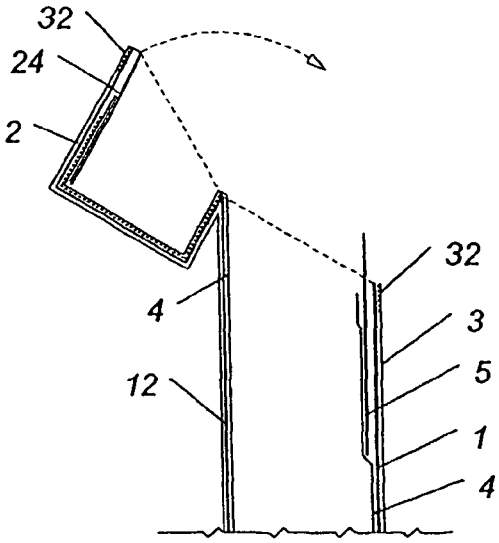
Figure 38:
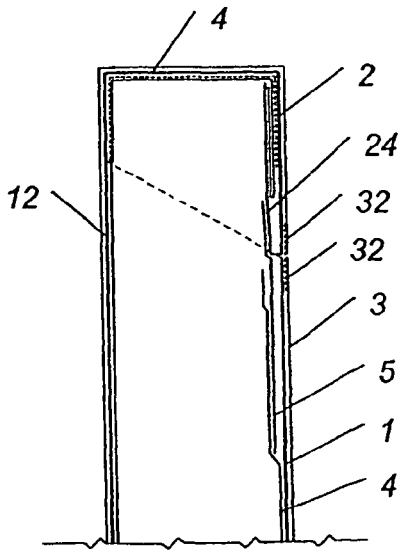

FIGS. 22 and 23 show the folding layouts of the basic body 1 and cap 2 and the stiffening element 5. FIGS. 27 and 28 show the closed packing according to the further embodiment which in its appearance does not differ from the first embodiment. FIGS. 29 to 32 show the first time opening of the further embodiment of the packing in accordance with the invention. It can be seen that in contrast to the first embodiment no part of the insert 4 remains on top of the packed merchandise. This can clearly be seen by a comparison of FIGS. 13 and 31.

The basic body 1 comprises the gluing points 101, 102, 104, 105 and 106, the cap comprises the gluing points 208, 209 and 211, the insert comprises the gluing points 404 and 411 and the stiffening element comprises the gluing points 505 and 506. The gluing points 101, 102 are required in the folding of the basic body 1 and the gluing points 208 and 209 in the folding of the cap 2. The other gluing points are glued together in such a manner that the same end figures come together, e.g. 211 with 411. It is sufficient when an adhesive or the like is applied to one of the two meeting gluing points.

FIGS. 33 to 38 show the process of the first-time opening and renewed closure of the further embodiment of the packing in accordance with the invention in a sectional view which corresponds to the first embodiment. Glued regions are characterized by a dotted line.

The invention claimed is:

1. A packing, in particular for cigarettes, comprising:

a basic body comprising a floor space and a first wall;

a cap comprising a cover surface and a second wall, with the basic body and the cap being joined with each other at a first side of the first wall and a first side of the second wall in a tiltable manner, with a gap being formed in the closed state of the packing between further sides of the first wall and the further sides of the second wall;

a protective wrapping being arranged around the basic body and the cap at least in the closed state of the packing, with the protective wrapping having a perforation in the region of the gap and is joined with the basic body and the cap at least in sections; and an insert arranged so as to rest on said basic body and said cap at least in the closed state of the packing and that said insert is connected to said cap at least in sections;

wherein said cap in the region of the further sides of said second wall comprises a tab which is inserted into a slot in said basic body, said tab can be flipped into said cap;

wherein said tab comprises at least one nose which can each be latched into a recess of said cap.

2. The packing according to claim 1, characterized in that the protective wrapping is glued at least over the entire length of the perforation with the basic body and the cap by means of an adhesive and that the adhesive seals openings of the perforation in the closed state of the packing.

3. The packing according to claim 2, characterized in that the adhesive is wax-like.

4. The packing according to one of the claims 1 to 3, characterized in that the protective wrapping is made integrally from a cellophane film.

5. The packing according to claim 1, characterized in that the insert comprises a closure region which can be severed from the insert along a further perforation and that the closure region is joined with the cap, at least in sections.

6. The packing according to claim 1, characterized in that the slot is formed by the first wall and a stiffening element.

7. The packing according to claim 5, characterized in that the tab is arranged in an offset fashion relative to the second wall substantially by the wall thickness of the first wall in the region of the gap, by means of a double fold.

8. A method to open a locked packing, said method comprising the steps of:

providing a cigarette packing comprising: a basic body comprising a floor space and a first wall; a cap comprising a cover surface and a second wall, with the basic body and the cap being joined with each other at a first side of the first wall and a first side of the second wall in a tiltable manner, with a gap being formed in the closed state of the packing between further sides of the first wall and the further sides of the second wall; a protective wrapping being arranged around the basic body and the cap at least in the closed state of the packing, with the protective wrapping having a perforation in the region of the gap and is joined with the basic body and the cap at least in sections; and an insert arranged so as to rest on said basic body and said cap at least in the closed state of the packing and that said insert is connected to said cap at least in sections;

severing the protective wrapping along the perforation;

flipping the cap open;

pulling a tab of the cap out of a slot in the basic body;

severing a closure region of the insert which is joined with the cap along a further perforation; and flipping the tab into the cap with the closure region being arrangeable at least partly between the cap and the tab;

wherein the tab is latched by means of noses in diametrically opposed recesses of the cap.

9. A packing for cigarettes, said packing comprising:

a basic body having a floor space and a first wall;

a cap having a cover surface and a second wall, with said basic body and said cap being joined with each other at a first side of said first wall and a first side of said second wall in a tiltable manner, with a gap being formed in the closed state of said packing between further sides of said first wall and said further sides of said second wall;

a protective wrapping being arranged around said basic body and said cap at least in the closed state of said packing, with said protective wrapping having a perforation in the region of said gap and is joined with said basic body and said cap at least in sections; and an insert arranged so as to rest on said basic body and said cap at least in the closed state of the packing and that said insert is connected to said cap at least in sections, said insert having a closure region which can be severed from said insert along a further perforation and that said closure region is joined with said cap, at least in sections;

wherein said cap in the region of said further sides of said second wall comprises a tab which is inserted into a slot in the basic body, said tab can be flipped into said cap, and wherein said tab comprises at least one nose which can each be latched into a recess of said cap.

10. The packing according to claim 9, characterized in that said protective wrapping is glued at least over the entire length of said perforation with said basic body and said cap by means of an adhesive and that said adhesive seals openings of said perforation in the closed state of said packing.

11. The packing according to claim 9, characterized in that said slot is formed by said first wall and a stiffening element.

12. The packing according to claim 11, characterized in that said tab is arranged in an offset fashion relative to said second wall substantially by the wall thickness of said first wall in the region of said gap, by means of a double fold.

13. The packing according to claim 12, characterized in that said basic body further comprising at least seven gluing points, said cap further comprising at least three gluing points, said insert further comprising at least three gluing points and said stiffening element further comprising at least two gluing points.

14. The packing according to claim 13, characterized in that at least two of said basic body gluing points are used in the folding of said basic body, at least two of said cap gluing points are used in the folding of said cap, at least two gluing points of said insert are used to join with at least two free gluing points of said basic body and said free gluing point of said insert is used to join with said free gluing point of said cap.

* * * * *